US009855669B2

(12) United States Patent
Klockow et al.

(10) Patent No.: US 9,855,669 B2
(45) Date of Patent: Jan. 2, 2018

(54) DICING MACHINES AND METHODS OF USE

(71) Applicant: Urschel Laboratories, Inc., Valparaiso, IN (US)

(72) Inventors: Scott Alan Klockow, Kouts, IN (US); James A. Fant, Chesterton, IN (US)

(73) Assignee: Urschel Laboratories, Inc., Chesterton, IN (US)

( * ) Notice: Subject to any disclaimer, the term of this patent is extended or adjusted under 35 U.S.C. 154(b) by 385 days.

(21) Appl. No.: 14/656,062

(22) Filed: Mar. 12, 2015

(65) Prior Publication Data

US 2015/0258701 A1 Sep. 17, 2015

Related U.S. Application Data

(60) Provisional application No. 61/952,218, filed on Mar. 13, 2014.

(51) Int. Cl.

| | |
|---|---|
| ***B26D 7/18*** | (2006.01) |
| ***B26D 3/22*** | (2006.01) |
| *B26D 9/00* | (2006.01) |

(52) U.S. Cl.

CPC ..... *B26D 7/18* (2013.01); *B26D 3/22* (2013.01); *B26D 9/00* (2013.01); *B26D 2007/1809* (2013.01); *Y10T 83/2118* (2015.04)

(58) Field of Classification Search

CPC ... B26D 7/18; B26D 3/22; B26D 9/00; B26D 2007/1809; B26D 7/0691; B26D 3/18; Y10T 83/2118

USPC ..... 83/403, 404, 39

See application file for complete search history.

(56) References Cited

U.S. PATENT DOCUMENTS

| | | | | |
|---|---|---|---|---|
| 4,625,606 A * | 12/1986 | Pinegar | ..... | B26D 3/22 83/403 |
| 4,743,307 A | 5/1988 | Mason | | |
| 4,782,729 A | 11/1988 | Mathot | | |
| 4,906,145 A | 3/1990 | Oliver | | |
| 5,129,299 A | 7/1992 | Fischer et al. | | |
| 5,249,494 A * | 10/1993 | Borvitz | ..... | B26D 3/18 83/302 |

(Continued)

FOREIGN PATENT DOCUMENTS

| | | |
|---|---|---|
| JP | 2004-321744 | 11/2004 |
| JP | 2008-178962 | 8/2008 |

(Continued)

*Primary Examiner* — Omar Flores Sanchez

(74) *Attorney, Agent, or Firm* — Hartman Global IP Law; Gary M. Hartman; Domenica N. S. Hartman

(57) ABSTRACT

Machines and methods capable of producing diced products from a variety of materials. Such a machine includes a knife adapted to slice food product to produce slices, a circular cutter comprising knives that are adapted and arranged to cut the slices into strips, a cross-cutter comprising knives that are adapted and arranged to produce a cross-cut in the strips, and a shear plate that is at least partially between the circular cutter and the cross-cutter. The shear plate defines a first shear edge in proximity to the knives of the cross-cutter and is adapted to ensure dicing of the strips received by the cross-cutter from the circular cutter. A support bar supports the shear plate, and a feature is provide for adjusting the proximity of the first shear edge relative to the knives of the cross-cutter.

20 Claims, 7 Drawing Sheets

(56) References Cited

U.S. PATENT DOCUMENTS

| | | | | |
|---|---|---|---|---|
| 5,425,307 | A | 6/1995 | Rush et al. | |
| 5,722,143 | A | 3/1998 | Bucks et al. | |
| 6,536,691 | B2 * | 3/2003 | Prewitt | A01J 27/04<br>241/101.01 |
| 2014/0345432 | A1 * | 11/2014 | Klockow | B26D 7/18<br>83/356.3 |

FOREIGN PATENT DOCUMENTS

| | | |
|---|---|---|
| JP | 2008-283907 | 11/2008 |
| KR | 10-2004-0083560 | 10/2004 |

* cited by examiner

DICING MACHINES AND METHODS OF USE

CROSS REFERENCE TO RELATED APPLICATIONS

This application claims the benefit of U.S. Provisional Application No. 61/952,218, filed Mar. 13, 2014, the contents of which are incorporated herein by reference.

BACKGROUND OF THE INVENTION

The present invention generally relates to methods and machines for cutting solid and semisolid materials, including food products.

The Affinity® dicer is a machine manufactured by Urschel Laboratories and is particularly well suited for dicing various materials, notable but nonlimiting examples of which include cheeses and meats. The Affinity® dicer is well known as capable of high capacity output and precision cuts. In addition, the Affinity® dicer has a sanitary design to deter bacterial growth.

A nonlimiting representation of an Affinity® dicer is shown in FIG. 1. Product is delivered to a feed hopper (not shown) and enters a rotating impeller 10, where centrifugal forces hold the product against an inner wall of a stationary case 12 equipped with a slicing knife 14. The slicing knife 14 is disposed in an opening in the case 12 and typically oriented approximately parallel to the rotational axis of the impeller 10. Paddles of the impeller 10 carry the product to the slicing knife 14, producing slices that enter a dicing unit of the machine. Specifically, slices pass between a rotating feed drum 16 and feed roll 18, then enter a rotating circular cutter 20 whose axis of rotation is approximately parallel to the rotational axes of the rotating feed drum 16 and feed roll 18. The circular cutter 20 is equipped with knives oriented approximately perpendicular to the rotational axis of the circular cutter 20 and, therefore, such that the knives cut each slice into strips. The strips pass directly into a rotating cross-cutter 22 whose axis of rotation is approximately parallel to the rotational axis of the circular cutter 20. The cross-cutter 22 is equipped with knives that, as shown, are oriented approximately parallel to the rotational axes of the cross-cutter 22, and therefore transverse and preferably perpendicular to the knives of the circular cutter 20, to produce final cross-cuts that yield a diced product. The rotational speed of the cross-cutter 22 is preferably independently controllable relative to the feed drum 16, feed roll 18 and circular cutter 20 so that the size of the diced product can be selected and controlled. As evident from FIG. 1, the rotational axes of the impeller 10, feed drum 16, feed roll 18, circular cutter 20, and cross-cutter 22 are all approximately parallel to each other.

FIG. 2 schematically represents a longitudinal cross-section of the cross-cutter 22 (not to scale) showing a hollow spindle 24 adapted to be coaxially mounted on a second spindle or shaft (38 in FIG. 3). The hollow spindle 24 defines a circumferential wall 26 in which slots 28 are formed for receiving knives 30 of the cross-cutter 22.

FIG. 3 is an exploded view showing individual components of the dicing unit of FIG. 1, including the feed drum 16, feed roll 18, circular cutter 20, and cross-cutter 22 and components associated therewith. As represented in FIG. 3, each of the feed drum 16, feed roll 18, circular cutter 20, and cross-cutter 22 is configured to be individually coaxially mounted on a separate shaft or spindle. In the nonlimiting representation of FIG. 3, the feed drum 16 and cross-cutter 22 are shown as being individually mounted on separate spindle shafts 38 and secured thereto with a retaining washer 40 and nut 42, and the feed roll 18 and circular cutter 20 are shown as being individually mounted on separate spindle shafts 44 and secured thereto with bolts 45.

FIG. 3 further represents a stripper or shear plate 32 supported and secured with bolts 36 to a support bar 34. The shear plate 32 has an upper shear edge 47 adapted to strip products (strips) from the circular cutter 20 prior to being diced with the cross-cutter 22. Slots 46 are defined in a surface of the shear plate 32 to accommodate the knives of the circular cutter 20. The slots 46 extend to the shear edge 47, such that individual edges of the shear edge 47 between adjacent slots 46 are able to remove strips from between adjacent knives of the circular cutter 20. A lower shear edge 48 of the shear plate 32 is in close proximity to the knives 30 of the cross-cutter 22 to ensure complete dicing of the strips delivered from the circular cutter 20 to the cross-cutter 22. The feed drum 16, feed roll 18, circular cutter 20, cross-cutter 22, shear plate 32, and support bar 34 are all shown as being cantilevered from a support structure 50 of the machine, for example, an enclosure, frame and/or other structures interconnected with the stationary case 12 and including drive systems operable to rotate the impeller 10, feed drum 16, feed roll 18, circular cutter 20, and cross-cutter 22 at the desired rotational speeds thereof.

From the above, it should be apparent that the feed drum 16, feed roll 18, circular cutter 20, cross-cutter 22, shear plate 32, and support bar 34 must be securely and precisely positioned relative to each other, for example, to ensure that the circular cutter 20, cross-cutter 22 and shear plate 32 do not move relative to each other to the extent that the knives of the circular cutter 20, the knives 30 of the cross-cutter 22, and the shear plate 32 do not interfere with each other. While completely adequate for many food processing applications, including cheeses for which the Affinity® is widely used, there is an ongoing desire for greater versatility in machines of this type, for example, in the ability to position the shear plate 32 relative to the cross-cutter 22, and in particular the lower shear edge 48 of the shear plate 32 relative to the knives 30 of the cross-cutter 22, to ensure complete dicing of the strips received from the circular cutter 20.

BRIEF DESCRIPTION OF THE INVENTION

The present invention provides machines and methods capable of producing diced products from a variety of materials.

According to one aspect of the invention, a machine is provided that includes a knife adapted to slice food product to produce slices, a circular cutter comprising knives that are adapted and arranged to receive the slices from the knife and cut the slices into strips, a cross-cutter comprising knives that are adapted and arranged to receive the strips from the circular cutter and produce a cross-cut in the strips, and a shear plate that is at least partially between the circular cutter and the cross-cutter. The shear plate defines a first shear edge in proximity to the knives of the cross-cutter and is adapted to ensure dicing of the strips received by the cross-cutter from the circular cutter. A support bar supports the shear plate, and the machine further includes means for adjusting the proximity of the first shear edge relative to the knives of the cross-cutter.

According to another aspect of the invention, a machine is provided for dicing solid and semisolid materials. The machine includes a knife adapted to slice food product to produce slices, a circular cutter comprising knives that are adapted and arranged to receive the slices from the knife and cut the slices into strips, a cross-cutter comprising knives that are adapted and arranged to receive the strips from the circular cutter and produce a cross-cut in the strips, and a shear plate at least partially between the circular cutter and the cross-cutter and having slots that receive the knives of the circular cutter. The shear plate defines a first shear edge in proximity to the knives of the cross-cutter and adapted to ensure dicing of the strips received by the cross-cutter from the circular cutter. The shear plate further has a second shear edge comprising individual edges between adjacent pairs of the slots for removing the strips from between adjacent pairs of the knives of the circular cutter. A support bar supports the shear plate, and the machine further includes means for adjusting the proximity of the first shear edge relative to the knives of the cross-cutter.

Other aspects of the invention include methods of using machines comprising elements such as those described above. A particular but nonlimiting example is to use the machine to dice food products.

A technical effect of the invention is the ability to position the shear plate relative to the cross-cutter, and in particular the lower shear edge of the shear plate relative to the knives of the cross-cutter, to ensure complete dicing of strips received from the circular cutter. Such a capability promotes the use of the machine for dicing a variety of solid and semisolid materials of varying consistencies, textures, hardnesses, etc., including but not limited to food products such as meat with connective tissue.

Other aspects and advantages of this invention will be better appreciated from the following detailed description.

DETAILED DESCRIPTION OF THE INVENTION

Figure 1:
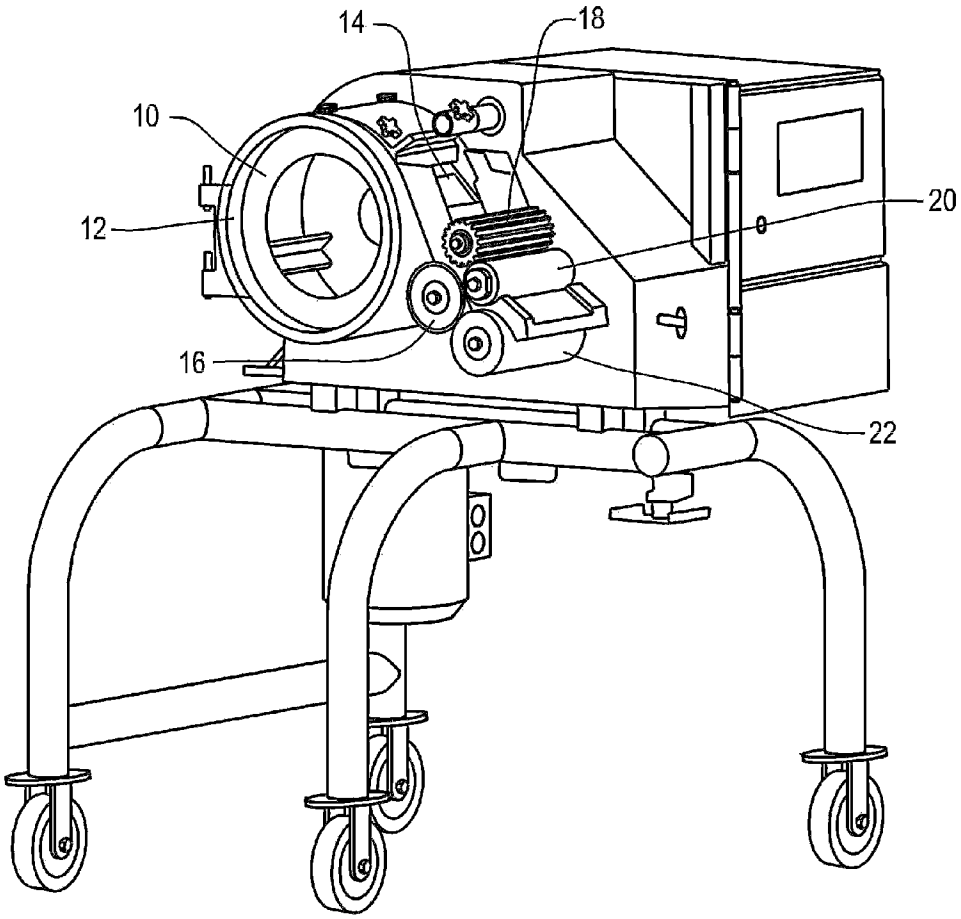
FIG. 1 (Prior Art)
FIG. 1 schematically represents an example of an Affinity® dicer machine.

FIG. 4 through 7 depict a shear plate 32 and support bar 34 configured as components of a dicing unit adapted to be installed on a dicing machine, as a nonlimiting example, the Affinity® dicer represented in FIG. 1. The dicing unit is adapted to cut a sliced product in a direction transverse to the cut that produced the sliced product (a "cross-cut") to achieve a dicing effect and produce a diced product. However, those skilled in the art will appreciate that the dicing unit and its benefits are not limited to such uses, nor limited to the Affinity® dicer.

Figure 2:
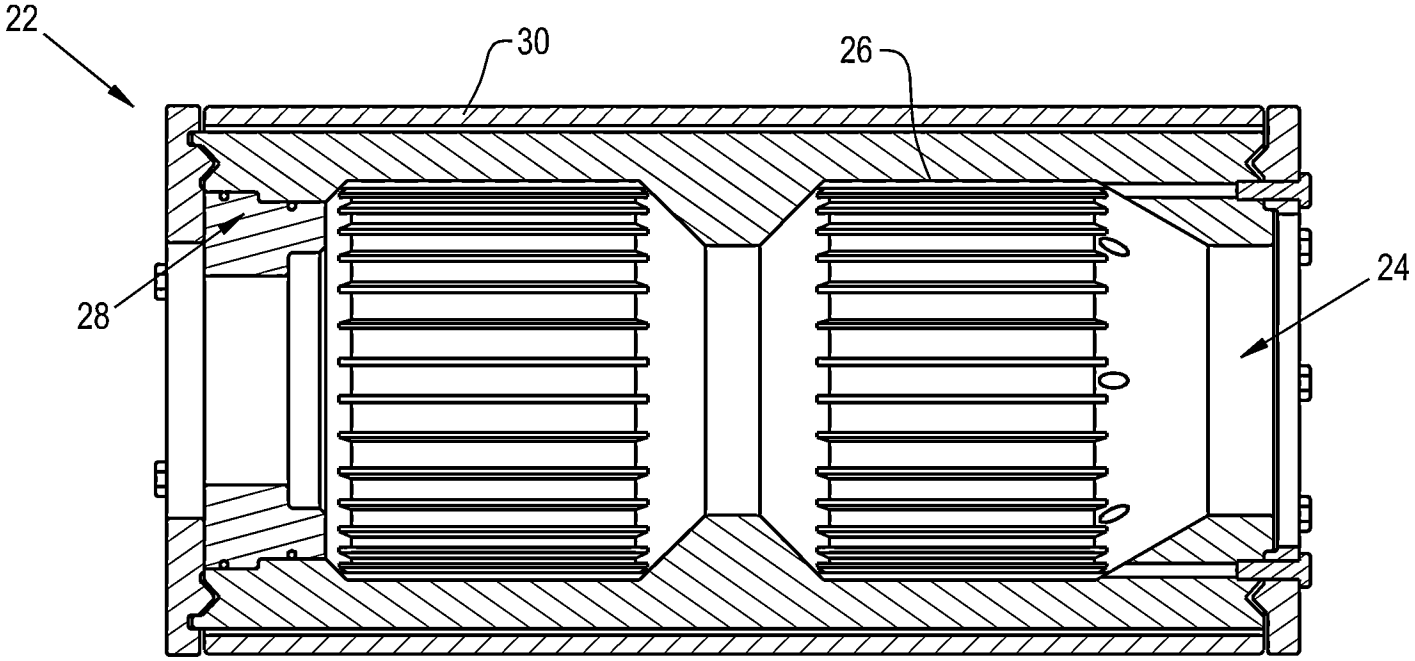
FIG. 2 (Prior Art)
FIG. 2 represents a fragmentary longitudinal cross-sectional view of a cross-cutter of the Affinity® dicer machine of FIG. 1.
Figure 3:
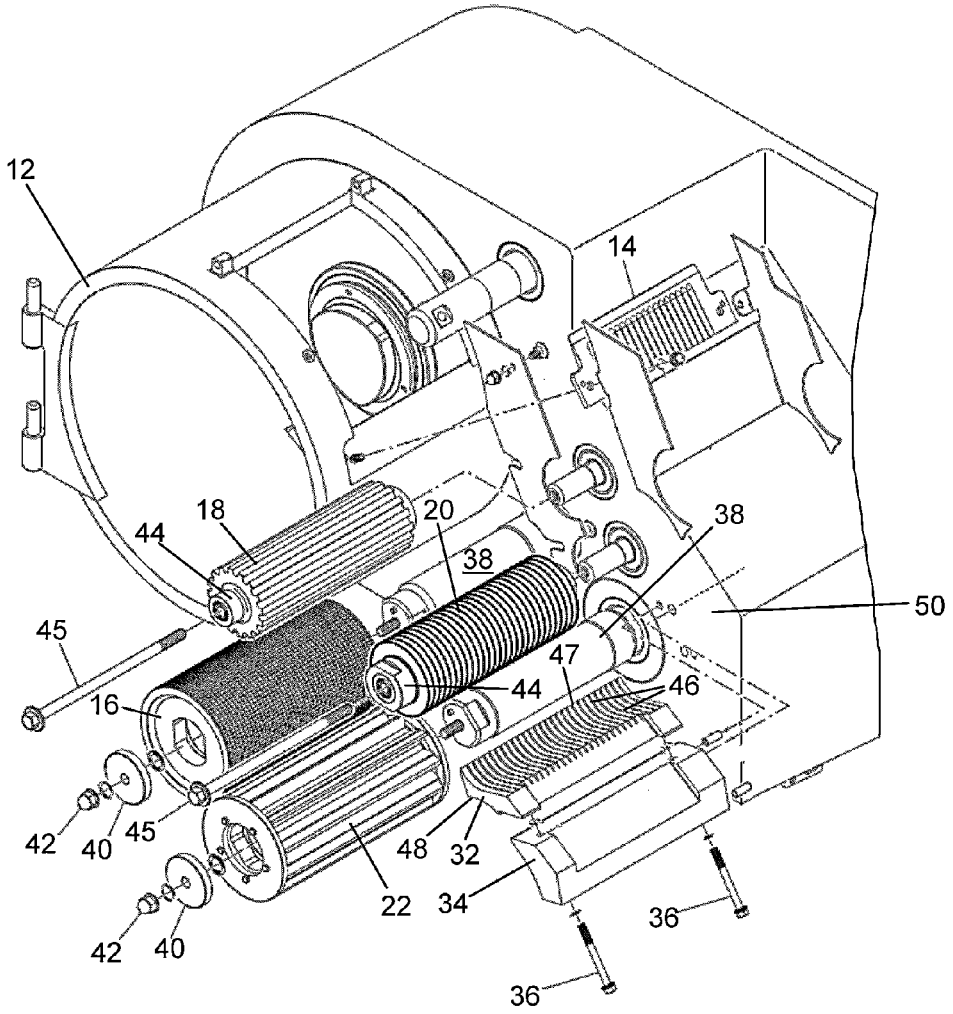
FIG. 3 (Prior Art)
FIG. 3 represents a fragmentary exploded view of a dicing unit of the Affinity® dicer machine of FIG. 1.

As represented in FIGS. 4 through 7, the dicing unit comprises components, including the shear plate 32 and support bar 34, that are similar to that shown for the Affinity® dicer in FIGS. 1 and 3. The terms "shear plate" and "support bar" will be used in reference to the shear plate 32 and support bar 34 represented in FIGS. 4 through 7, though it should be understood that these terms encompass other means capable of the functions of the shear plate 32 and support bar 34, for example, means capable of stripping products (strips) from a first cutting device, means capable of ensuring complete cutting of the products from a second cutting device, and support means therefor. Furthermore, in the nonlimiting embodiment represented in FIGS. 4 through 7, the shear plate 32 and support bar 34 are configured to permit their use as part of a retrofit unit for the Affinity® dicer of FIGS. 1 through 3, in that the dicing unit primarily comprises components that can be additional to or substituted for components shown in FIG. 1 through 3. However, it should be appreciated that the dicing unit could also be provided as original equipment on a dicing machine. Because of the similarities between the dicing unit and its shear plate 32 and support bar 34 (hereinafter collective referred to as a shear unit 35) of FIGS. 4 through 7 and the dicing unit of FIGS. 1 and 3, the following discussion of FIGS. 4 through 7 will focus primarily on aspects of the dicing and shear units of FIGS. 4 through 7 that differ from the dicing unit of FIGS. 1 and 3 in some notable or significant manner. Other aspects of the dicing and shear units of FIGS. 4 through 7 not discussed in any detail can be, in terms of structure, function, materials, etc., essentially as was described for the dicing and shear units of FIGS. 1 and 3. Furthermore, consistent reference numbers are used in the figures to identify the same or functionally equivalent elements.

The shear plate 32 is at least partially between the circular cutter 20 and cross-cutter 22, and is accurately positioned relative to the circular cutter 20 and cross-cutter 22 in order to remove products (strips) from the circular cutter 20 and its knives 31 (FIG. 7) prior to the strips being cut by the knives 30 of the cross-cutter 22 in a transverse direction to the cuts made by the knives 31, resulting in what is termed herein as "dicing" to produce a "diced" product. In particular, upper and lower shear edges 47 and 48 of the shear plate 32 are disposed between the circular cutter 20 and cross-cutter 22. As evident from FIG. 7, the slots 46 in the shear plate 32 individually accommodate the knives 31 of the circular cutter 20, so that individual edges of the upper shear edge 47 between adjacent slots 46 remove strips from between adjacent knives 31. Furthermore, as evident from FIG. 7, the lower shear edge 48 of the shear plate 32 is in close proximity to the knives 30 of the cross-cutter 22 to ensure complete dicing of the strips received from the circular cutter 20.

Figure 4:
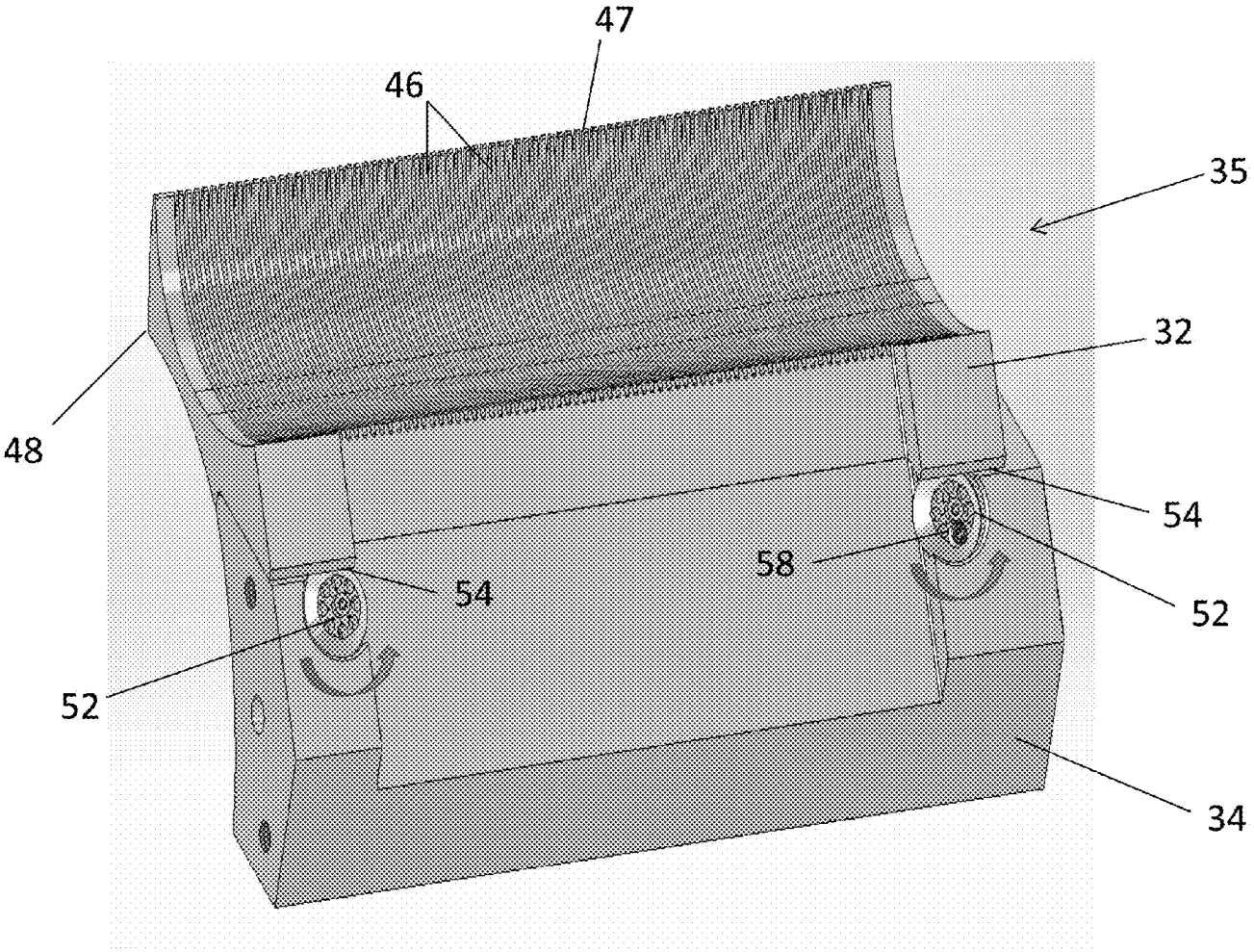
FIG. 4 represents a fragmentary perspective view of a shear plate and support bar suitable for use in a dicing unit, for example, of the Affinity® dicer machine of FIG. 1.
Figure 5:
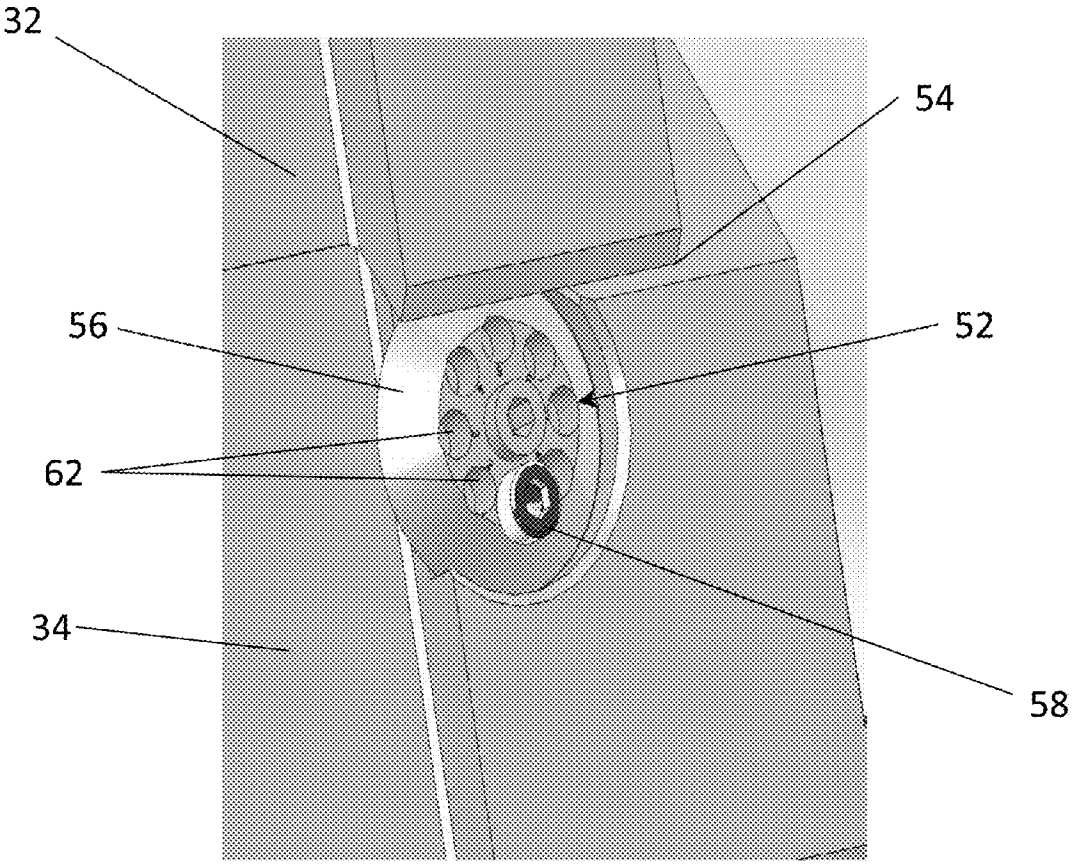
FIG. 5 is a detailed view of a camming feature of the shear plate in FIG. 4.
Figure 6:
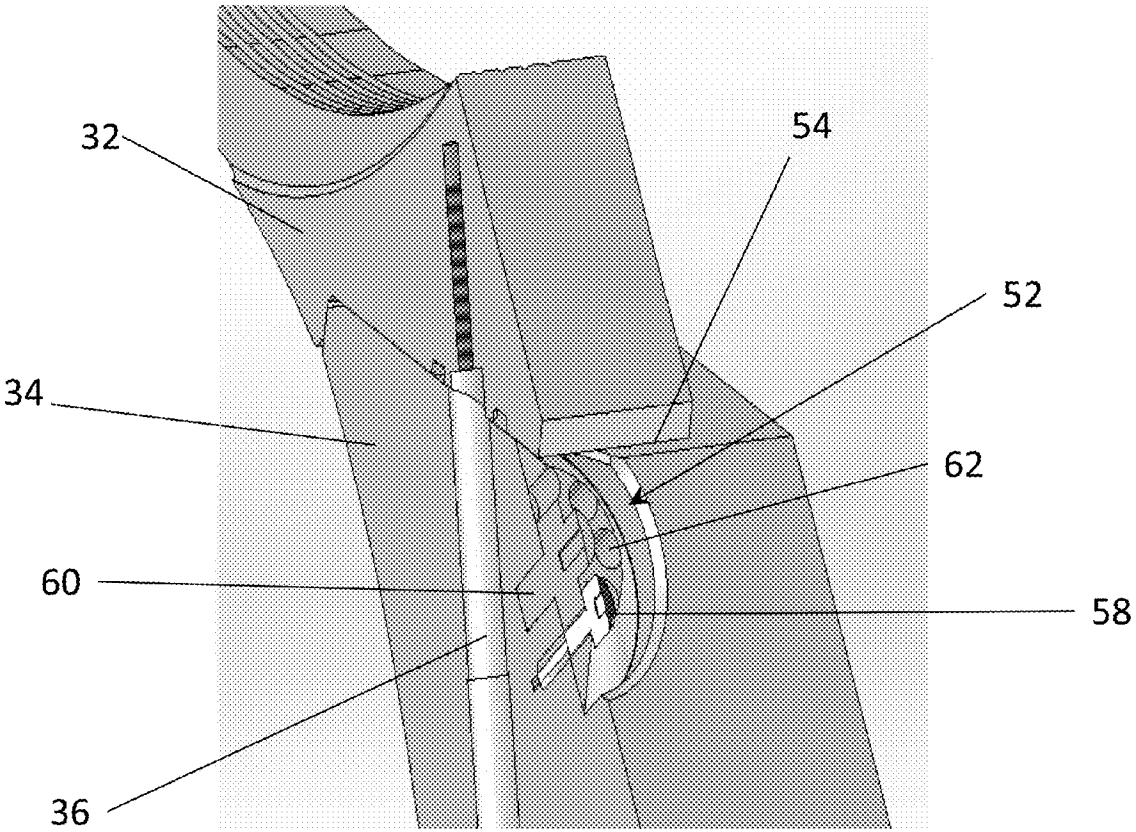
FIG. 6 is a fragmentary perspective view of the shear plate and support bar of FIG. 5, including a cross-section of the camming feature thereof.
Figure 7:
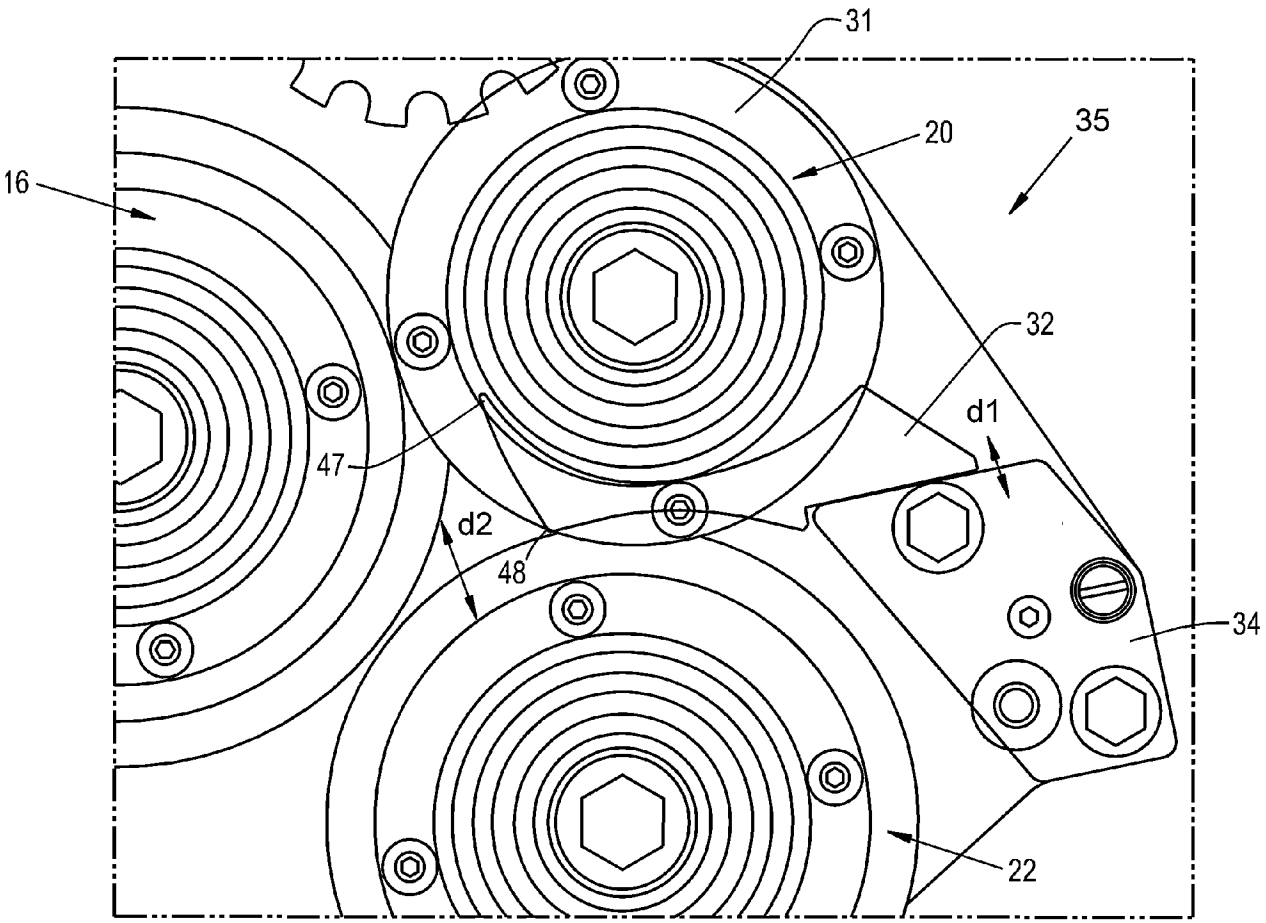
FIG. 7 is an end view of a dicing unit in which the shear plate and support bar of FIGS. 4 through 6 are installed, and evidencing an adjustment capability for the camming feature.

The shear unit 35 of FIGS. 4 through 7 is intended to permit greater precision with respect to the placement and proximity of the lower shear edge 48 of the shear plate 32 relative to the knives 30 of the cross-cutter 22 to ensure complete dicing of strips received from the circular cutter 20 and its knives 31. To enable adjustment of the distance between the shear edge 48 and knives 30 of the cross-cutter 22, FIG. 4 represents a pair of camming features 52 partially disposed between the support bar 34 and a back edge 54 of the shear plate 32 opposite its shear edges 47 and 48. As evident from FIG. 6, each camming feature 52 is configured to have a disk-shaped head on an axle 60, both of which are received in complementary-shaped recesses in the support bar 34. As depicted in FIGS. 4 through 6, the head of each camming feature 52 may have a frustoconical-shaped edge that defines a camming surface 56 (FIG. 5), which as seen in FIGS. 4 through 6 bears against the back edge 54 of the shear plate 32. The axial extent of the camming surface 56 gradually varies so that rotation of the camming feature 52 about an axis defined by its axle 60 causes displacement of the back edge 54 of the shear plate 32 relative to the support bar 34. In turn, this movement of the shear plate 32 causes the shear plate 32 to tilt relative to the support bar 34. As evident from FIG. 7, increased tilting of the shear plate 32 in this manner causes the shear edge 48 of the shear plate 32 to move toward the cross-cutter 22, thus reducing the distance (clearance) between the lower shear edge 48 of the shear plate 32 and the knives 30 of the cross-cutter 22. As a nonlimiting example, movement of a distance (d1) of about 0.001 inch (about 25 micrometers) at the back edge 54 of the shear plate 32 may result in movement of a distance (d2) of about 0.002 inch (about 50 micrometers) at the shear edge 48 of the shear plate 32. In preferred embodiments, the camming feature 52 is capable of causing movement of at least 0.015 inch (about 380 micrometers) at the shear edge 48. Once a desired clearance is attained, a fastener 58 can be installed through one of several preformed through-holes 62 in the head of the camming feature 52 and, as depicted in FIG. 5, threaded or otherwise engaged with the support bar 34 to lock the rotational position of the camming feature 52 on the support bar 34. The entire shear plate 32 is supported and secured to the support bar 34, for example, with at least one bolt 36 shown in FIG. 6.

The ability to finely adjust the clearance between the lower shear edge 48 of the shear plate 32 and the knives 30 of the cross-cutter 22 as described above promotes the versatility of the shear unit 35 and a dicing unit in which it is installed. As a nonlimiting example, the adjustability of the lower shear edge 48 promotes the capability of producing diced products from a variety of solid and semisolid materials of varying consistencies, texture, hardness, etc., including but not limited to food products such as meat with connective tissue.

While the invention has been described in terms of a specific embodiment, it is apparent that other forms could be adopted by one skilled in the art. For example, the physical configurations of the dicing machine, dicing unit, shear unit 35, and/or their components could differ from those shown, and various materials and processes could be used in their manufacture. Therefore, the scope of the invention is to be limited only by the following claims.

The invention claimed is:

1. A machine comprising:

a knife adapted to slice food product to produce slices;

a circular cutter comprising knives that are adapted and arranged to receive the slices from the knife and cut the slices into strips;

a cross-cutter comprising knives that are adapted and arranged to receive the strips from the circular cutter and produce a cross-cut in the strips;

a shear plate that is at least partially between the circular cutter and the cross-cutter, the shear plate defining a first shear edge in proximity to the knives of the cross-cutter and adapted to ensure dicing of the strips received by the cross-cutter from the circular cutter;

a support bar supporting the shear plate; and means for adjusting the proximity of the first shear edge relative to the knives of the cross-cutter to cause the first shear edge to move toward and away from the cross-cutter and thereby reduce and increase, respectively, a distance between the first shear edge and the knives of the cross-cutter.

2. The machine according to claim 1, wherein the adjusting means tilts the shear plate relative to the support bar.

3. The machine according to claim 1, further comprising means for locking the adjusting means.

4. The machine according to claim 1, wherein the adjusting means comprises a camming feature having a camming surface disposed between the shear plate and the support bar.

5. The machine according to claim 4, wherein the camming feature tilts the shear plate relative to the support bar and thereby causes the first shear edge of the shear plate to move toward and away from the cross-cutter and to reduce and increase, respectively, a distance between the first shear edge and the knives of the cross-cutter.

6. The machine according to claim 4, wherein the camming feature comprises an axle and the camming surface tilts the shear plate relative to the support bar by rotation of the camming feature about the axle.

7. The machine according to claim 6, wherein the axle is received in a complementary recess in the support bar.

8. The machine according to claim 4, further comprising means for locking the camming feature.

9. The machine according to claim 4, wherein the camming feature is adapted to cause movement of at least 380 micrometers at the first shear edge.

10. A method of using the machine of claim 4, the method comprising rotating the camming feature about an axis thereof to cause the camming surface to tilt the shear plate relative to the support bar.

11. The machine according to claim 1, wherein the shear plate further comprises a second shear edge and slots that receive the knives of the circular cutter, the second shear edge comprising individual edges between adjacent pairs of the slots for removing the strips from between adjacent pairs of the knives of the circular cutter.

12. The machine according to claim 1, wherein the machine is a dicing machine that dices solid and semisolid materials.

13. A method of using the machine of claim 1, the method comprising rotating the adjusting means about an axis thereof to tilt the shear plate relative to the support bar and thereby adjust the proximity of the first shear edge relative to the knives of the cross-cutter.

14. A machine for dicing solid and semisolid materials, the machine comprising:

a knife adapted to slice food product to produce slices;

a circular cutter comprising knives that are adapted and arranged to receive the slices from the knife and cut the slices into strips;

a cross-cutter comprising knives that are adapted and arranged to receive the strips from the circular cutter and produce a cross-cut in the strips;

a shear plate at least partially between the circular cutter and the cross-cutter and having slots that receive the knives of the circular cutter, the shear plate defining a first shear edge in proximity to the knives of the cross-cutter and adapted to ensure dicing of the strips received by the cross-cutter from the circular cutter, the shear plate further comprising a second shear edge comprising individual edges between adjacent pairs of the slots for removing the strips from between adjacent pairs of the knives of the circular cutter;

a support bar supporting the shear plate; and means for adjusting the proximity of the first shear edge relative to the knives of the cross-cutter to cause the first shear edge to move toward and away from the cross-cutter and thereby reduce and increase, respectively, a distance between the first shear edge and the knives of the cross-cutter.

15. The machine according to claim 14, wherein the adjusting means tilts the shear plate relative to the support bar.

16. The machine according to claim 14, wherein the adjusting means comprises a camming feature having a camming surface disposed between the shear plate and the support bar.

17. The machine according to claim 16, wherein the camming feature tilts the shear plate relative to the support bar and thereby causes the first shear edge of the shear plate to move toward and away from the cross-cutter to reduce and increase, respectively, a distance between the first shear edge and the knives of the cross-cutter.

18. The machine according to claim 16, wherein the camming feature comprises an axle and the camming surface tilts the shear plate relative to the support bar by rotation of the camming feature about the axle.

19. A method of using the machine of claim 16, the method comprising rotating the camming feature about an axis thereof to cause the camming surface to tilt the shear plate relative to the support bar.

20. A method of using the machine of claim 14, the method comprising rotating the adjusting means about an axis thereof to tilt the shear plate relative to the support bar and thereby adjust the proximity of the first shear edge relative to the knives of the cross-cutter.

* * * * *